United States Patent [19]

Tortorici

[11] 3,945,123

[45] Mar. 23, 1976

[54] DEVICE FOR DRAWING OBJECTS IN PERSPECTIVE

[76] Inventor: Carl Tortorici, 3566 S. Lake Drive, Boynton Beach, Fla. 33435

[22] Filed: Nov. 29, 1974

[21] Appl. No.: 528,036

[52] U.S. Cl. ..... 33/77; 33/104

[51] Int. Cl.[2] ..... B43L 13/14

[58] Field of Search ..... 33/77, 104

[56] References Cited

UNITED STATES PATENTS

| | | | |
|---|---|---|---|
| 1,723,517 | 8/1929 | McFadden | 33/104 |
| 2,610,407 | 9/1952 | McQuaid | 33/104 |
| 2,713,205 | 7/1955 | Nielsen | 33/104 |

FOREIGN PATENTS OR APPLICATIONS

| | | | |
|---|---|---|---|
| 616,080 | 1/1949 | United Kingdom | 33/104 |
| 373,334 | 5/1932 | United Kingdom | 33/104 |

*Primary Examiner*—Richard E. Aegerter
*Assistant Examiner*—Steven L. Stephan
*Attorney, Agent, or Firm*—Malin & Haley

[57] ABSTRACT

A pre-calibrated or pre-scaled geometrical instrument having no moving parts which provides necessary indicia on the face of the device which allows a draftsman or the like to draw objects in perspective, the indicia information including the right and left vanishing points, scaled indicia along the picture ground line and center vision and alternate measuring points. Each device is calibrated with indicia for a particular object viewing angle. The device itself is planar shaped with one surface having the necessary indicia disposed thereon. Predetermined surface edges of the device represent the picture ground lines and a ground measuring line.

3 Claims, 4 Drawing Figures

DEVICE FOR DRAWING OBJECTS IN PERSPECTIVE

BACKGROUND OF THE INVENTION

This invention relates generally to an instrument for drawing objects in perspective and more specifically to a geometrical instrument shaped for a predetermined desired perspective viewing angle, the device providing pre-calibrated indicia in the form of lines and symbols on one surface of the device to provide all the necessary information to expedite the construction of perspective drawings at a predetermined given viewing angle.

Many geometrical instruments have been shown in the prior art which have attempted to expedite and aid a draftsman or the like in the preparation of perspective drawings. Perspective drawings are time consuming in that several different points must be determined on the drawing surface in the preparation of a perspective drawing for a particular object, the determination of these points by a draftsman being time consuming. Many of the devices shown in the prior art are quite complicated and utilize a plurality of moving parts which must themselves be properly positioned in order to aid the draftsman in determining particular positions and lines to be drawn on the drawing surface to accomplish constructing an object in perspective on a drawing surface which is two dimensional. As is well known, the purpose of a perspective drawing is to provide on a two dimensional surface a representative drawing of a object to emphasize and display three dimensional characteristics which are optically perceived by the eye. The theory of perspective drawings has been well developed and discussed in the prior art. No device has been shown in the prior art having no moving parts which can provide all the necessary measurement points required to achieve a perspective drawing. Applicant's invention provides a planar shaped perspective drawing instrument having no moving parts, the indicia providing necessary calibrated measuring points which allows one to complete a perspective drawing more quickly.

BRIEF DESCRIPTION OF THE INVENTION

A geometric device for drawing objects in perspective comprising a planar body member having a cut-away upper surface edge, said surfaces joined to form a pair of angularly disposed surface edges representative of ground plane picture lines, said side and upper edges terminating in a pair of apexes, each apex representing a right and left vanishing point, a calibrated predetermined indicia scale placed on one surface of said body, the calibrated indicia providing a plurality of line calibrations along a predetermined ground plane line and along the edges of the device representative of the picture ground plane line, and additional indicia which is properly scaled for each respective angular side of the object to be drawn along the picture ground plane and a plurality of indicia representative of a center of vision and measuring points if desired.

The dimensional sides of the device and the scaled indicia placed on the surface of the device are determined from a geometrical formula in order to construct the body of the device in a proper size such that the vanishing points, the height above the base of the object representative of the observer's eye line and the picture ground line scales are properly proportioned to provide the necessary indicia for the construction and drawing of an object in perspective on the respective drawing paper itself. The display indicia may be provided on the body of the instrument described or in another embodiment may be placed on the drawing paper itself. In determining the scale indicia for the picture ground lines, a ratio of the ground measuring line and the picture ground line distances are determined through the use of the cosine of the angle on the respective side of the device which is utilized as the viewing angle of the object to be drawn as presented to the observer's eye. The distance of the center of vision to the various vanishing points is determined utilizing the ratio of the height from the base of the device to the observer's eye line or the horizon which results from the tangent of the angle in question. The geometrical and mathematical descriptions of the construction of the basic device is described below in more detail.

In operation to utilize the instant invention a draftsman need only place the instrument on the working surface upon which the perspective object is to be drawn. The left and right vanishing points are provided by the apexes on opposite ends of the measuring instrument body itself. A line may be drawn connecting the vanishing points which establishes the eye measuring line or the horizontal line. In one embodiment of the invention a pre-calibrated scale may be provided for a proportional reduction which may be useful to a draftsman or the like or in an alternate embodiment the scale instrument provides for center vision and measuring points using standard drawing distances.

It is an object of this invention to provide an improved drawing instrument for drawing objects in perspective.

It is another object of this invention to provide a perspective drawing instrument which reduces time and increases the accuracy of the drawing for anyone using the device.

And yet still another object of this invention is to provide an improved drafting tool for perspective drawings which provides on the device itself, predetermined vanishing points, center vision and center vision measuring points, including scaled calibration indicia for the ground plane lines.

In accordance with these and other objects which will be apparent hereinafter, the instant invention will now be described with particular reference to the accompanying drawings.

PREFERRED EMBODIMENT OF THE INVENTION

Figure 1:
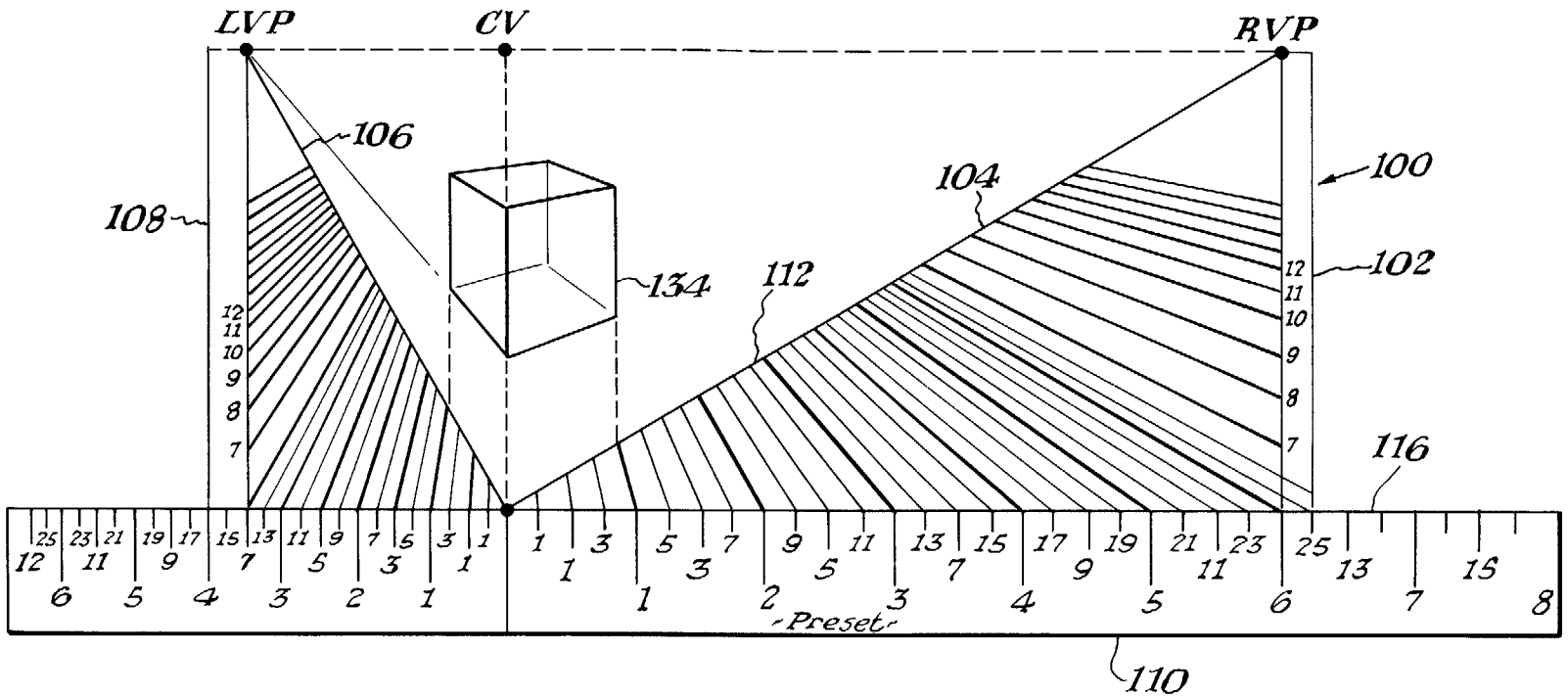
FIG. 1 shows a top plan view of one embodiment of Applicant's invention.

Referring now to the drawings and in particular FIG. 1, Applicant's drawing device is shown generally at 100 comprising a planar body having a right edge 102, a left edge 108 and a pair of cut-away edges 104 and 106 which terminate to form a right angle along the ground measuring line 116. The apex of each portion of the device on the left and right provide for left vanishing points (LVP) and right vanishing points (RVP). The device is shown as it would be utilized constructing an object 134 in perspective, showing indicia which would be on the drawing paper itself. The center of vision (CV) and the line connecting the left vanishing point and right vanishing point would be on the paper. The body 100 includes a planar bottom edge 110 which contains the scale indicia numbers which will be described below. The ground measuring scale shows a plurality of indicia on both the left and right side of the center vision point of the device with the scale on each side being of a different proportion to provide proper proportions along the picture ground lines 104 and 106 necessary to draw the object at the respective angle correctly. The device in FIG. 1 is shown to show an object in a 30°/60° perspective, the angle in the body of the device 106 makes with ground measuring line 116 being 60° and the angle between the picture ground line surface 112 and the ground measuring line 116 being 30°. This provides a viewing angle for the object 134. With such a viewing angle, the sides as shown in perspective of object 134 will have different lengths in order to show it as it would appear to the eye of the observer. The preset scale measurement has been determined to provide the proper ratio so that the particular unitary distance which is known by the draftsman for the preparation of the drawings may be adjusted to the scale for the sides so that the object is shown correctly in perspective. The determination of how the scaled indicia was achieved is discussed below.

Figure 2:
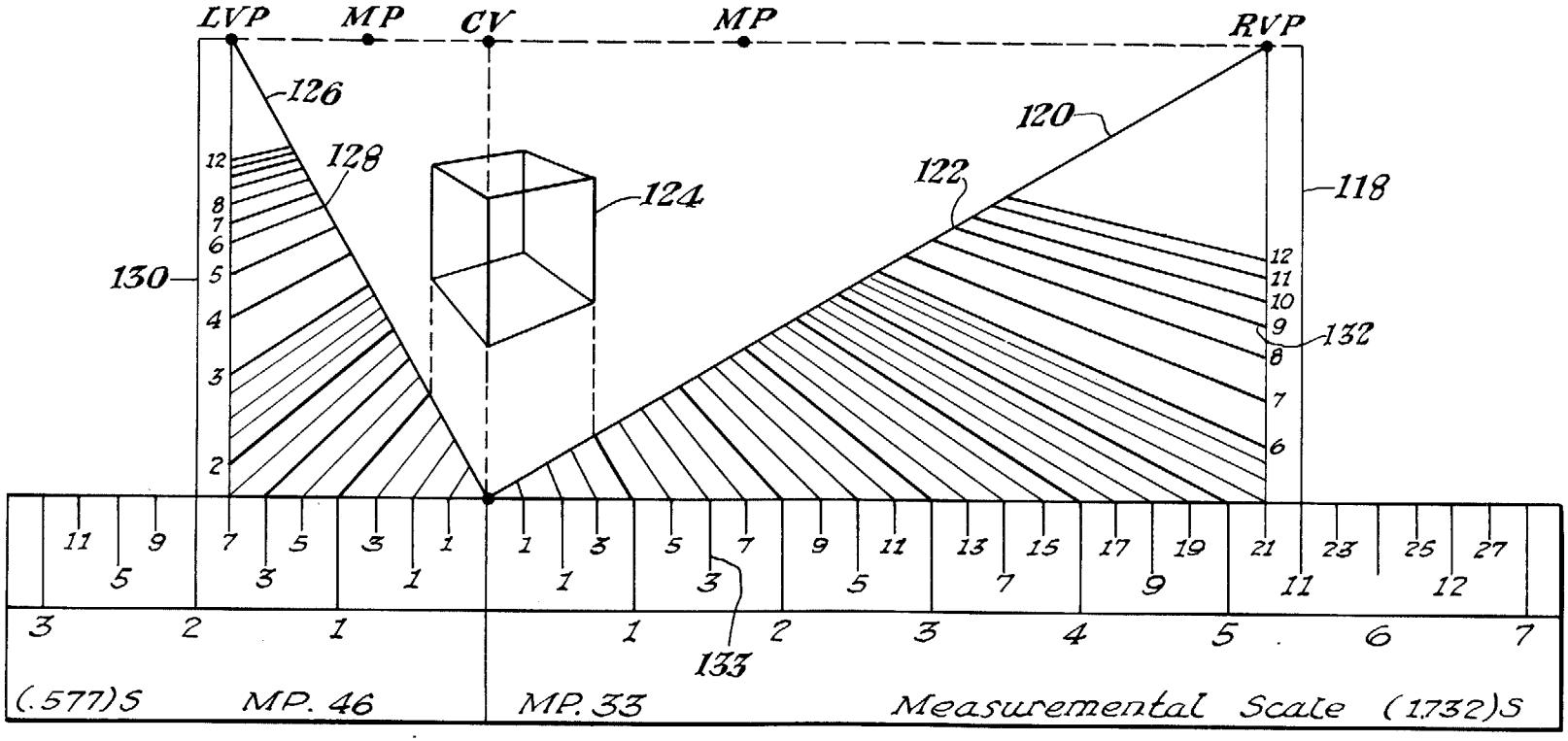
FIG. 2 shows a top plan view of an alternate embodiment of Applicant's invention.

FIG. 2 shows an alternate embodiment of Applicant's invention in which the scaled indicia provides for a true measurement scale and includes information to allow one to properly scale the device to a standard measuring unit, such a one inch. Also included on the face of the device are information regarding measuring points which have been predetermined and allow being of the draftsman's choice are properly scaled and oriented if the various reductions are required in constructing the object. As shown in FIG. 2, an object 124 which is a cube has been drawn above the body of the device. In the alternate embodiment of FIG. 2 using the measuremental scale, in some situations it may be desirous instead of having the ground picture line proportions being scale lines proceeding through the center of vision as shown in FIG. 1, the measuremental scale utilizes a pair of measuring points whose distance is proportional determined between the left vanishing point and the center of vision and the right vanishing point and the center of vision. These measuring points are then utilized to construct lines which terminate at the edge of the picture ground line 120 and 126 which go through the measuring points on the opposite side of the CV. With this type of scale, the draftsman may desire in order to practically show an object so that it not distorted as it would be observed in the eye of a person perceiving the object. For example, scale line terminating in point 122 would be drawn from point 132 through the measuring point between the left vanishing point and the CV. A similar example measuremental line at 128 would be drawn through measuring point between the center of vision and the right vanishing point in order to construct the indicia as it will be presented on the scale. The location of the measuring points on the scale ulilized is also provided on the face of the device to aid the draftsman in the utilization of the scale. The use of the alternate embodiment shown in the FIG. 2 would be primarily if a particular object would not appear in a perspective drawing as it would in real life because of being distorted.

Figure 3:
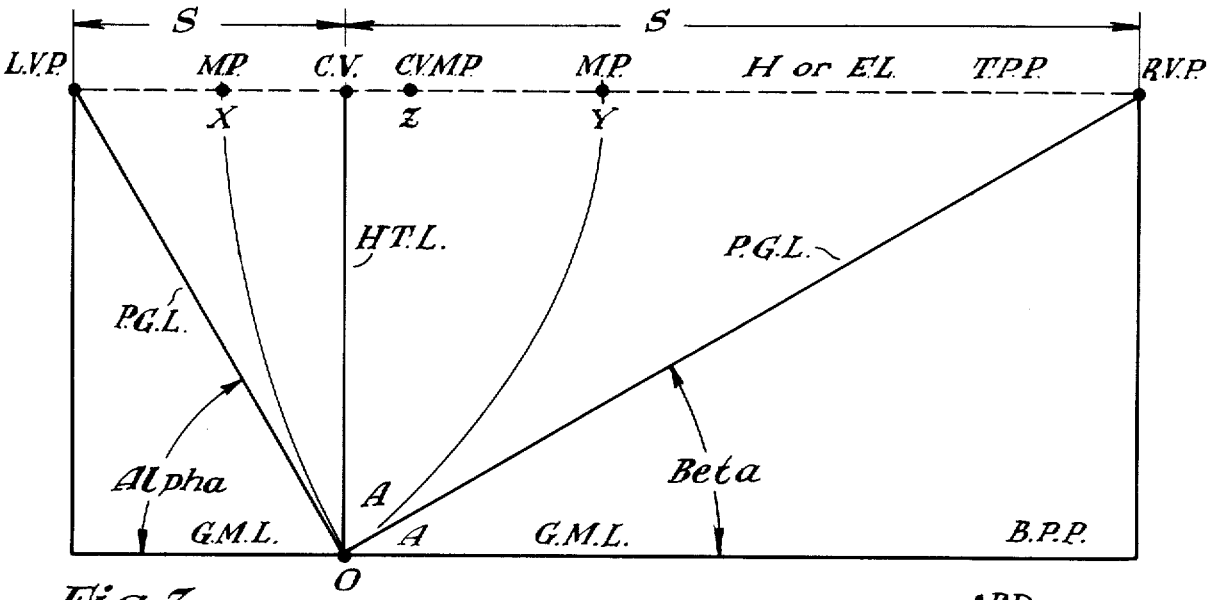
FIG. 3 shows a schematic diagram of the geometrical angles and lines utilized to determine the construction and the indicia scale utilized in Applicant's invention.

FIG. 3 shows geometrically determination of how angles alpha and beta which are representative of the observing angle desired with the device are utilized to determine the proper scale or indicia necessary for the invention.

In order to determine the particular dimensions of thedevice to be constructed, the broad mathematical formulas to determine the necessary distances can be selected as follows: First, the angle alpha is selected which represents the particular angle which will be utilized in showing a particular drawing in perspective. The complimentary angle, beta, is then equal to 90° minus alpha. Also to determine the particular size of a device to be constructed, the distance along the vertical measuring line is selected which is the height above the base of the object to the eye level line between "O" and C.V. The proper scale between the ground measuring line and the picture ground line may then be obtained by finding the cosines of the angle alpha and angle beta, the cosine representing the ratio between the scale on the ground measuring line and the picture ground line. After the cosine scale has been determined for the ground measuring line, then unit measures may be constructed and drawn on the device beginning from a center point outwardly in equal lengths dependent on the particular scale desired. In order to provide the proper measuring points on the picture ground line, lines are drawn on the scale points on the ground measuring line to the CV in the preset embodiment of FIG. 1 and to measuring points MP in FIG. 2. At the point where these lines cross the picture ground line, they represent the scaled points on the picture ground line that are scaled in a ratio to the ground measuring line. These points may then be placed on the device and utilized for proper scale drawings along the picture ground line.

To determine the distance from the CV or center vision to the right and left vanishing points, first the distance HTL has already been established. Then to compute the distances, the co-tangent of alpha is multiplied times the distance HTL which produces the proper measurement distance from CV to the right vanishing point. To determine the left vanishing point, the distance HTL is multiplied times the co-tangent of the angle beta. Once these distances are established and since HTL is already known, the proper dimensions for the device itself are known so that the device can be constructed.

To determine positions of measuring points MP on the right and left hand side of the device from center vision (CV) utilized in the embodiment shown in FIG. 2, a ratio between the distance from CV to the right and left vanishing points is established. These measuring points may be utilized to accentuate particular objects that are drawn as desired by the draftsman or artist. In the instant invention, the measuring points and the ratio is determined by taking the distance PGL and extending an arc from point "O" to "H" with the measuring points shown as X and Y. The arc is centered at the LVP and RVP respectively. such that the points where the arcs intersect, the eye level line between the left vanishing point and the right vanishing point, these particular points will then be the measuring points. A square formed along the PGL with opposite sides intersecting through line E.L. serves the same purpose. From a simple measurement it is then determined that there is a ratio or percentage distance between the CV and the measuring points and the total distance from the CV to the right and left vanishing points, with the ratio being different on each side of the device and each side of the CV.

Figure 4:
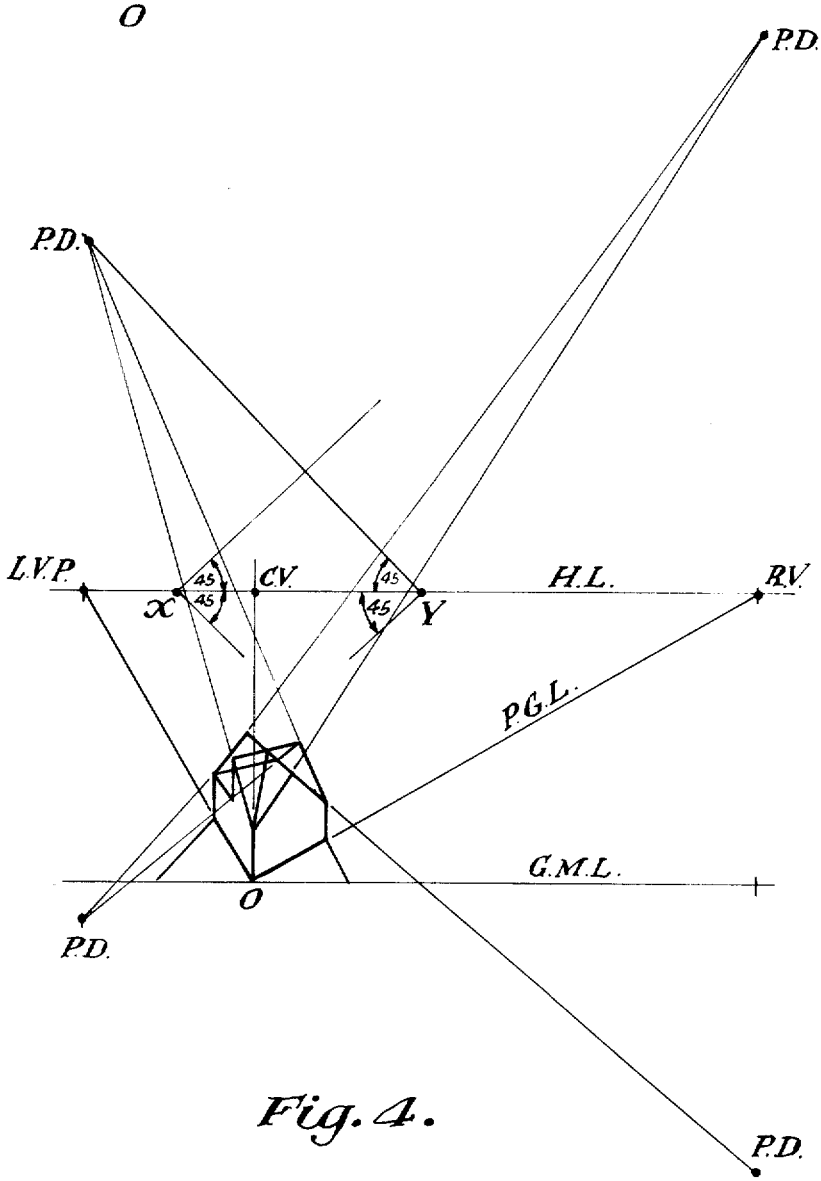
FIG. 4 is a schematic drawing showing alternate uses of Applicant's invention.

FIG. 4 shows additional uses which can be found for Applicant's device which includes determining the point of distance for luminary (PD) and the foot of luminary (FTL). The measuring points are found by drawing an arc from (O) the observer to the picture plane or the height line which is centered on the left and right vanishing points. The point of distance for luminary and the foot luminary provide vanishing points for shadows. The foot of luminary lies in the vertical axis of the luminary and is generally found in the horizon line when shadows are cast by the sun. The measuring point shown here as X and Y are points found on the picture plane and horizon line which are used for conveying dimensions from the ground measuring line to points in perspective. The diagonals of the object which is being drawn may be utilized in that rectangles are the same proportion as common diagonals irrespective of their size. When similar rectangles are arranged parallel to one other, the diagonals are also parallel and share a common vanishing point or point of distance. Inclined planes which are inclined to the ground have vanishing points above or below the horizon line. These vanishing points can also be determined through the use of the measuring points. A line at the required angle of inclination is set out through the measuring point on the horizon line and extended to meet a vertical through its respective vanishing point. This gives the required vanishing point for the required angle in perspective. As shown in FIG. 4, an object is drawn in perspective having several inclined planar surfaces and utilizing measuring points on the horizon line which helps to determine the point of distances for the various planar surfaces. Thus utilizing the measuring points X and Y as shown in FIG. 4, the point of distance of luminary PDL which represents the sun's rays and the other point of distances for diagonals through the rectangular surfaces of the device can be established. This provides for proper shading and other information necessary when drawing complicated inclined surface devices. Thus utilizing Applicant's invention, with the measuring points as provided, can simplify and reduce the work load with much of the preliminary information being provided from Applicant's device.

The following are abbreviations and definitions utilized in describing the instant invention:

| | | |
|---|---|---|
| Alpha & Beta | = | Angle |
| O | | Observer |
| H.T.L. | | Height line, above base of object |
| E.L. | | Eye Level |
| H. | | Horizon |
| P.P. | | Picture Plane |
| G.M.L. | | Ground Measuring Line |
| P.G.L. | | Picture Ground Line |
| C.V. | | Center of Vision |
| C.V.M.P. | | Center of Vision Measuring Point |
| Z. | | In proportion to angle, Center of X + Y |
| M.P. | | Measuring Point |
| X & Y | | M.P. Alternative to Scale |
| L.V.P. | | Left Vanishing Point |
| R.V.P. | | Right Vanishing Point |
| S | | Position of object with reference to picture plane, tangent of angle Alpha & Beta |
| A | | Desired perspective distance along G.M.L. & P.G.L. |

-continued

| | |
|---|---|
| A (FIG. 1) | Measurement — In reference to cosine of angle Alpha & Beta on G.M.L. to C.V. or Z to obtain measurement on P.G.L. |
| A (FIG. 2) | Unit measurement — in reference to 1" scale, on G.M.L. to X + Y. To obtain measurement on P.G.L. |
| A | Either measuring point or center of vision can be used or a combination of both. |
| M.P. | Measuring Point (X + Y) — a point found on the picture plane and Horizon Lone (H.L.) used for conveying dimensions from ground measuring line (G.M.L.) to points in perspective (P.G.L.). |
| X + Y | Measuring point is also found by drawing an arc from (0) observer to P.P. or H.L. centered on left and right vanishing point (L.V.P. + R.V.P.) the Hypotenuse of angle. |

The instant invention has been shown and described herein in what is considered to be the most practical and preferred embodiment. it is recognized, however, that departures may be made therefrom within the scope of the invention and that obvious modifications will occur to a person skilled in the art.

What I claim is:

1. A device to aid a draftsman or the like for drawing objects in perspective comprising:

a planar body, said body having a substantially straight base edge, a substantially straight left upper surface edge, a substantially straight right upper surface edge, said left and right upper surface edges being joined together to form a predetermined angle, said angle to be utilized in the drawing of a perspective figure, a left vertically disposed side edge, a right vertically disposed side edge, the upper end of said left upper surface edge forming a left vertex adjacent the upper end of said left side edge, the upper end of said right upper edge forming a right vertex adjacent the upper end of said right side, said left vertex representing a left vanishing point and said right vertex representing a right vanishing point, a first scale having a plurality of linearly spaced indicia disposed on said body adjacent the base edge of said body for use with the right upper edge and a second scale having a plurality of linearly spaced indicia disposed on said body adjacent the base edge of said body for use with said left upper surface edge, a third scale having a plurality of spaced indicia disposed on said body adjacent said right upper edge, said third scale indicia being determined by the intersection of a plurality of lines connecting said first scale indicia to a pre-determined point lying outside of said body and a fourth scale having a plurality of indicia disposed on said body adjacent said left upper edge, said fourth scale indicia being determined by the intersection of a plurality of lines connecting said second scale indicia to a single pre-determined point lying outside of said body.

2. A device as in claim 1, wherein:

said pre-determined points lying outside of said body represents the center vision of said perspective drawing.

3. A device as in claim 1, wherein:

the pre-determined points lying outside the body for the determination of said third and fourth indicia scales are the same point.

* * * * *